US006736953B1

(12) United States Patent
Zhu et al.

(10) Patent No.: US 6,736,953 B1
(45) Date of Patent: May 18, 2004

(54) HIGH FREQUENCY ELECTROCHEMICAL DEPOSITION

(75) Inventors: Mei Zhu, San Jose, CA (US); Zhihai Wang, Sunnyvale, CA (US)

(73) Assignee: LSI Logic Corporation, Milpitas, CA (US)

( * ) Notice: Subject to any disclaimer, the term of this patent is extended or adjusted under 35 U.S.C. 154(b) by 309 days.

(21) Appl. No.: 09/966,651

(22) Filed: Sep. 28, 2001

(51) Int. Cl.[7] ..... C25D 5/18; C25D 7/12; C25D 5/02

(52) U.S. Cl. ..... 205/103; 205/105; 205/157; 205/118; 205/123

(58) Field of Search ..... 205/102, 103, 205/105, 157, 118, 123

(56) References Cited

U.S. PATENT DOCUMENTS 6,303,014 B1 * 10/2001 Taylor et al. ..... 205/103
6,432,821 B1 * 8/2002 Dubin et al. ..... 438/678
6,440,289 B1 * 8/2002 Woo et al. ..... 205/103

OTHER PUBLICATIONS

S. Gandikota, et al., "Extension of Copper Plating to 0.13 micron Nodes by–Pulse–Modulated Plating," Proceedings of The International Interconnect Technology Conference, California, Jun. 2000.

* cited by examiner

*Primary Examiner*—Edna Wong
(74) *Attorney, Agent, or Firm*—Luedeka, Neely & Graham

(57) ABSTRACT

A method of forming an electrically conductive structure on a substrate. An electrically conductive electrode layer is formed on the substrate, and an electrically conductive conduction layer is formed over the electrode layer. The conduction layer is formed by placing the substrate in a plating solution. A first current is applied to the substrate at a first bias and a first density for a first duration. A second current is applied to the substrate at a second bias and a second density for a second duration. The first current and the second current are cyclically applied at a frequency of between about thirty hertz and about one hundred and thirty hertz.

13 Claims, 1 Drawing Sheet

HIGH FREQUENCY ELECTROCHEMICAL DEPOSITION

FIELD

This invention relates to the field of integrated circuit fabrication. More particularly, this invention relates to a method of depositing one or more conductive layers as part of a very large scale integrated circuit using a high frequency pulse reverse electrochemical deposition technique.

BACKGROUND

As integrated circuits become more complex, it becomes necessary to develop new structures and fabrication techniques to reduce the overall size of the integrated circuits. One technique for reducing the physical size of an integrated circuit is to form multi layered structures where metallic interconnects, separated by interlevel dielectric layers, overlay one another to define various electrical pathways. As the size of the circuit is reduced, electrical contacts, via holes and other structures are typically made smaller and located in closer proximity to one another.

Metallic layers are often deposited to form electrical interconnects. One typical deposition process is low frequency pulse reverse plating. Low frequency pulse reverse plating has a number of associated drawbacks that tend to diminish the operation of the integrated circuit. Trenches, such as vias, trenches, and dual damascene structures that are fabricated with low frequency pulse reverse plating tend to have defects such as voids, irregular surface profiles and impurities. These defects tend to inhibit the proper operation of the integrated circuits manufactured according to these methods, resulting in an associated reduction in the device yield achieved during the manufacturing process.

As the trend toward fabrication of devices having smaller feature sizes and higher performance continues, there are increasing incentives to avoid the fabrication problems such as described above. The development and use of improved processing techniques can achieve both better device performance, and minimize production costs by improving the device yield during manufacturing.

What is needed, therefore, is a method for processing a substrate to form trenches, which method tends to improve the performance characteristics and device yield of the integrated circuits.

SUMMARY

The above and other needs are met by a method of forming an electrically conductive structure on a substrate. An electrically conductive electrode layer is formed on the substrate, and an electrically conductive conduction layer is formed over the electrode layer. The conduction layer is formed by placing the substrate in a plating solution. A first current is applied to the substrate at a first bias and a first density for a first duration. A second current is applied to the substrate at a second bias and a second density for a second duration. The first current and the second current are cyclically applied at a frequency of between about thirty hertz and about one hundred and thirty hertz.

In various preferred embodiments the density of the second current is between about two times and about four times the density of the first current. Most preferably the first bias is a forward bias and the second bias is a reverse bias. The first duration is preferably between about four and about twenty milliseconds, most preferably corresponding to a depletion time of the plating solution, and the second duration is preferably between about one and about four milliseconds, most preferably corresponding to a replenishment time of the plating solution.

By cycling the forward bias and the reverse bias in the plating solution for the durations and current densities described above, and at the frequency described above, a layer of material is deposited on the substrate that exhibits a reduced amount of defects, such as voids and impurities. Without being bound to theory, the reduction in voids and the reduction in impurities may be attributed to the relatively short forward bias time, which tends to allow the desired reactants in the plating solution sufficient time to transport to the reaction sites on the substrate, and thus reduces both the amount of impurities that are deposited onto the substrate out of the plating solution and the amount of unwanted byproduct gasses that are produced during those times when the desired reactants are depleted. Another purpose of the reverse bias is to etch the metallic deposition at the comers of trench or via openings. Deposition at the comers will block the deposition inside the features and is the one of the main reasons that voids are formed.

In an alternate embodiment of the method for forming an electrically conductive structure on a substrate, an etched feature is formed in the substrate. An electrically conductive electrode layer is formed on the substrate, and an electrically conductive conduction layer is formed on the electrode layer. The conduction layer is formed by placing the substrate in a plating solution. A first current is applied to the substrate at a first bias and a first density for a first duration, where the first duration corresponds to a depletion time of the plating solution in the etched feature. A second current is applied to the substrate at a second bias and a second density for a second duration, where the second duration corresponds to a replenishment time of the plating solution in the etched feature.

The second current tends to etch the substrate and keep the top of the features on the substrate open for that period of time before they are completely filled with the material of the conduction layer. Once the features are filled with the material of the conduction layer, the function of the second current is, at least in part, to prevent the conduction layer from over growing on top of the features, which tends to produce a flat surface instead of a dome shaped surface. Therefore, either the density of the second current, or the duration of the current may need to change after the features are filled. A dead time is applied where no current is applied to the substrate. The first current, second current, and dead time are cyclically applied at a frequency of between about thirty hertz and about one hundred and thirty hertz.

According to another aspect of the invention, an integrated circuit is described, where the improvement is an electrically conductive structure formed according to one or more of the methods described above.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
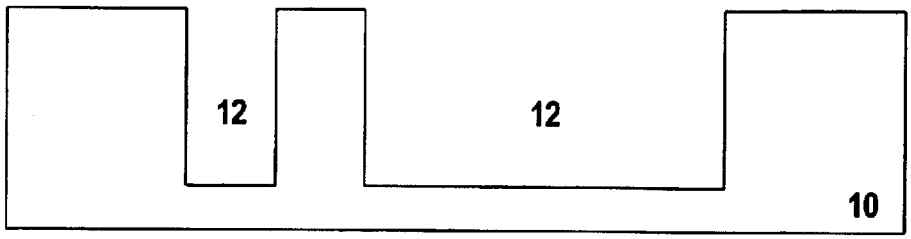
FIG. 1 is a cross sectional view of a substrate, including trenches and a seed layer.

With initial reference to FIG. 1, a cross sectional depiction of a substrate 10 having trenches 12 is shown. It is appreciated that the trenches 12 are representative of a variety of different structures, and further that the present invention is also applicable to planar substrates 10 having no structures thereon. However, some of the benefits of the present invention are particularly realized in applications where there are etched features such as trenches 12, and more particularly where some of the etched features have a relatively high aspect ratio, and others of the features have a relatively low aspect ratio. In other words, the present invention has benefits that are particularly applicable to substrates with etched features having a wide range of aspect ratios.

A seed layer, not depicted, is preferably formed on the surface of the substrate 10. Depending upon the material from which the seed layer is formed, and the material from which the substrate 10 is formed, it may be desirable to form a barrier layer between the seed layer and the substrate 10. For example, if the seed layer is copper, and the substrate 10 is a dielectric material, such as one or more of a silicon oxide or a low k material, then there is preferably provided a barrier layer between the copper seed layer and the substrate 10, such as a tantalum or tantalum nitride layer. It is appreciated that many different barrier layer formulations may be used in conjunction with the present invention, as desired.

The seed layer is preferably predominantly formed of a material that is selected to be the same material as that from which a subsequently deposited conduction layer is to be formed. In a most preferred embodiment, the material from which the seed layer is predominantly formed is copper. A physical vapor deposition process or a chemical vapor deposition process is preferably used to deposit the seed layer over the substrate 10. As described in more detail below, the seed layer preferably functions as an electrode during subsequent processing of the substrate 10.

Figure 2:
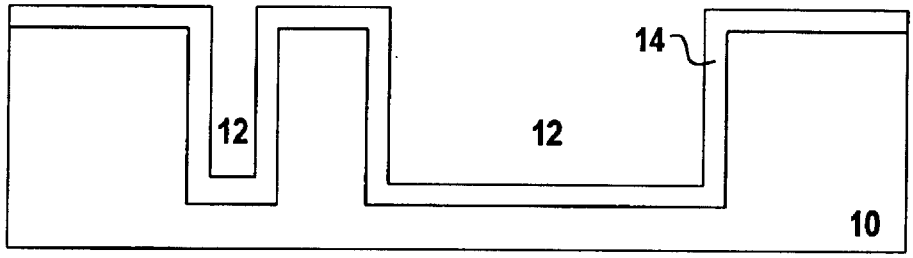
FIG. 2 is cross sectional view of the substrate of FIG. 1, including a patch layer.

As depicted in FIG. 2, a patch layer 14 is preferably formed over the substrate 10. Most preferably, the patch layer 14 is formed by electroplating in a plating solution, where one of the electrodes is provided by the seed layer on the surface of the substrate 10, as described above. Most preferably, the material used to form the patch layer 14 is substantially the same as the material used to form the seed layer. In integrated circuit technology embodiments, the preferred material for both the seed layer and the patch layer 14 is copper.

The patch layer 14 is preferably formed in a continuous direct current deposition. The patch layer 14 functions to increase the thickness of the seed layer, thus also acting as an electrode. However, the patch layer 14 is preferably not formed to too great a thickness. The desired thickness of the patch layer 14 is based at least in part on one or more different considerations. For example, in a subsequent deposition step described below, both etch and deposition take place. It is desirable that the patch layer 14 be thick enough so that the patch layer 14 and seed layer are not completely removed in any portions across the surface of the substrate 10. If such removal were to occur, then the electroplating process would tend to not take place in such regions.

On the other hand, the patch layer 14 is preferably not too thick. To a certain extent, the patch layer 14 tends to be deposited at about the same thickness in all portions of the substrate 10. However, if the direct current deposition of the patch layer 14 lasts too long, then depletion of the plating solution occurs, and most especially in the narrower etched features. This tends to work against the goals of the process, where a greater thickness of material is desired in the trenches 12, to fill the trenches 12, and a lesser thickness of material is desired on the surface of the substrate 10 between the trenches. Thus, the deposition process used for the patch layer 14 is not desirable for more than a minimum desirable thickness as explained above.

Figure 3:
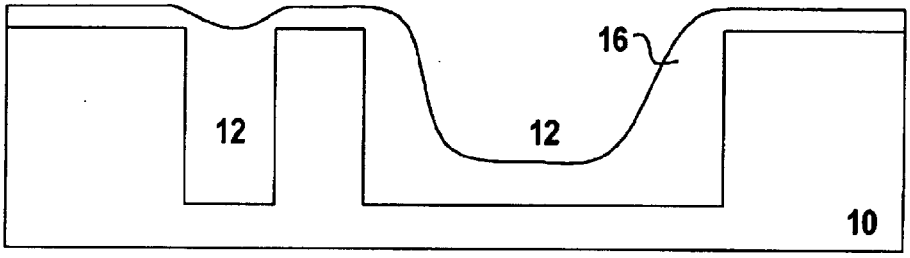
FIG. 3 is a cross sectional view of the substrate of FIG. 2, including part of a conduction layer.

As depicted in FIG. 3, a conduction layer 16 is formed over the patch layer 14. According to a most preferred embodiment of the invention, the conduction layer 16 is formed by electroplating using the patch layer 14 as an electrode. As described in more detail below, the electroplating process includes a number of associated application parameters which tend to minimize the introduction of impurities into the structure of the electrically conductive structure being formed and provide a desired deposition profile.

In accordance with the invention, the electroplating process includes the application of a high frequency current waveform, which tends to preferentially fill in or gap fill the trenches 12, rather than build up deposited material on the surfaces of the substrate 10 between the trenches 12. The electroplating process as described below further tends to minimize gas generation, which in turn tends to result in a reduced number of voids throughout the electrically conductive structure, and also tends to reduce the inclusion of impurities in the film.

Figure 4:
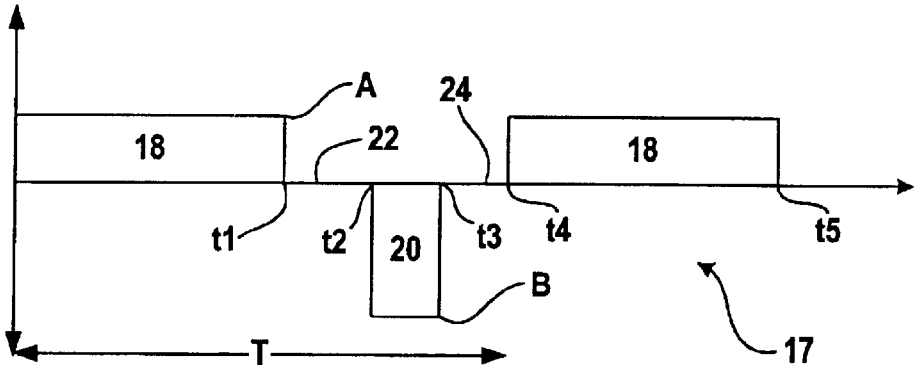
FIG. 4 is a waveform of current density versus time during deposition of the conduction layer.

Referring now to FIG. 4, and in accordance with a preferred embodiment of the invention, a pulse reverse waveform 17 used during the electrochemical deposition process is illustrated. FIG. 4 depicts current density on the abscissa versus time on the ordinate. Current density is expressed in units such as milliamperes per square centimeter, and time is expressed in units such as milliseconds. As shown in FIG. 4, a current having a forward bias is first applied, followed by a current having a reverse bias. Thus, the electrochemical deposition process that forms the conduction layer 16 is called pulse reverse filling, because of the reverse bias current applied during the formation of layer 16.

With continuing reference to FIG. 4, and for purposes of better explaining the invention, the pulse reverse waveform 17 applied during the electrochemical deposition process is broken down and described in terms of a number of constituent parts. Thus, during the electrochemical deposition process which forms the layer 16, a positive or forward bias current is applied, beginning at time zero and ending at a time $t_1$, wherein $t_1$ is most preferably from about four to about twenty milliseconds. The positive bias current applied to the substrate 10 during this time interval, defined herein as pulse 18, operates to attract ions from the plating solution to the patch layer 14. For the most preferred embodiment of the invention, the plating solution contains copper ions, which during pulse 18 plate onto the patch layer 14, thus forming the conduction layer 16.

During this first time interval $t_1$, also referred to as a forward bias on time, the most preferred density A of the current is between from about ten to about thirty milliamperes per square centimeter, where the area is the area of the substrate 10 being plated. In accordance with a most preferred embodiment of the invention, the forward bias on time and density has a direct relationship to the amount of ion depletion at the surface of the substrate 10, and most especially in the trenches 12. Thus, selecting the forward bias on time and density to not deplete the copper ions in the plating solution that can transport to the reaction sites, tends to provide better gap fill of the trenches 12 by the electrochemical deposition process.

A reverse bias current is applied to the substrate 10. The reverse bias current applied during this time interval, $(t_3-t_2)$, is called the reverse current pulse 20, and is most preferably applied for between about one and about four milliseconds. During the application of the reverse current pulse 20, copper atoms are drawn away from the substrate 10, tending to influence the surface profile characteristics of the copper conduction layer 16. By choosing the density and duration of the forward current pulse 18 and the reverse current pulse 20, in accordance with the most preferred embodiment of the invention, the resulting surface profile of the conduction layer 16 tends to be relatively flat, with the etched trenches 12 preferentially filling, and the surfaces of the substrate 10 between the trenches 12 preferentially etching.

During the time interval $(t_3-t_2)$, also referred to as the reverse bias on time, the density B of the reverse current is most preferably between about two and about four times the density of the forward current. A dead time 24, designated as the time interval $(t_4-t_3)$, follows the reverse current pulse 20. During the dead time 24, no current is applied to the substrate 10. Most preferably, the time interval, $(t_4-t_3)$, is less than four milliseconds.

In accordance with a most preferred embodiment of the invention, the sum of the dead time 24, $(t_4-t_3)$, and the reverse current pulse 20 on time, $(t_3-t_2)$, is approximately on the same order as the relaxation or replenishment time for the plating solution. In other words, this length of time is preferably close to that length of time necessary to allow additional ions, such as copper ions, to transport into the depletion zone at the surfaces of the substrate 10 from other portions of the plating solution.

This time is most preferably correlated to such replenishment times present within the trenches 12, and most particularly within the relatively high aspect ratio trenches 12. This is especially important for trenches 12 having a width on the order of about 0.09 microns or less. Having the sum of the dead time 24 and the reverse current pulse 20 on time approximately on the same order as the replenishment time within the trenches 12 tends to provide both improved control over the surface profile of the electrically conductive structure and a reduction in gas inclusion and impurity inclusion during the electrochemical deposition process.

A. The period T of the pulse reverse waveform 17 is defined as the time between the leading edge of the forward current pulse 18 to the leading edge of a subsequent forward current pulse 18. Most preferably, the period T is between about 0.03 seconds and about 0.006 seconds, where T equals the sum of the time intervals, $t_1$, $(t_2-t_1)$, $(t_3-t_2)$, and $(t_4-t_3)$. The frequency of the pulse reverse waveform 17 is defined as the reciprocal of the period T of the pulse reverse waveform 17. Accordingly, the frequency of the pulse reverse waveform 17 is between about thirty cycles per second and about one hundred and fifty cycles per second. It is appreciated that the period T of the pulse reverse waveform 17 may be adjusted to provide a desired surface profile.

Figure 5:
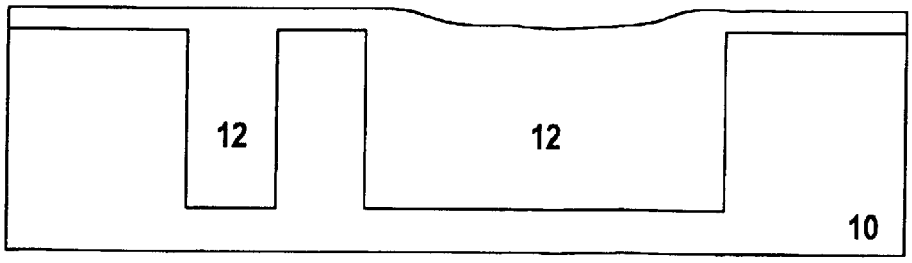
FIG. 5 is a cross sectional view of the substrate of FIG. 3, including a bulk filled layer.

Referring now to FIG. 5, having deposited the conduction layer 16 of copper, the larger trenches 12 are preferably filled to completion using a bulk fill process. It is appreciated that the more narrow trenches 12, where depletion of the ions in the plating solution at the reaction sites and closing of the trench or via openings is more of a problem, are preferably completely filled during the formation of the conduction layer 16 using the high frequency pulsed process as described above. Once the smaller trenches 12 are filled, the same waveform, or a slightly different waveform with a higher ratio of etch time to deposit time can be used to reduce and preferably stop the over plating of the small trenches 12.

As described above, it is appreciated that other types of conductive film may be electrically deposited over the substrate 10 using the techniques described herein, including any obvious modifications thereof.

An integrated circuit having an electrically conductive structure manufactured as described above tends to have superior electrical characteristics over an integrated circuit manufactured according to typical processes. Thus, the present invention provides a substantial homogeneous deposition of copper by controlling the consumption and replenishment of ions such as copper during the electrochemical deposition process, with a unique pulse reverse waveform 17.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A method of forming an electrically conductive structure on a substrate, the method comprising the steps of:

(a) forming an electrically conductive electrode layer on the substrate, and (b) forming an electrically conductive conduction layer over the electrode layer by;

(i) placing the substrate in a plating solution, (ii) applying a first current to the substrate at a first forward bias and a first density for a first duration, (iii) applying a second current to the substrate at a second reverse bias and a second density for a second duration, and (iv) cyclically applying the first current and the second current at a frequency of between about thirty hertz and about one hundred and thirty hertz, (v) wherein the second density of the second current is between about two times and about four times the first density of the first current.

2. The method of claim 1 wherein the first duration is between about four and about twenty milliseconds.

3. The method of claim 1 wherein the second duration is between about one and about four milliseconds.

4. The method of claim 1 further comprising the step of forming an etched feature in the substrate prior to the step of forming the electrode layer.

5. The method of claim 1 wherein the first duration corresponds to a depletion time of the plating solution.

6. The method of claim 1 wherein the second duration corresponds to a replenishment time of the plating solution and an etch time of corners of trenches in the substrate.

7. The method of claim 1 further comprising immediately applying the second current after the application of the first current without a dead time between the application of the first current and the application of the second current.

8. The method of claim 1 further comprising a dead time between the application of the second current and the succeeding application of the first current, where no current is applied to the substrate.

9. A method of forming an electrically conductive structure on a substrate, the method comprising the steps of:

(a) forming an etched feature in the substrate, (b) forming an electrically conductive electrode layer on the substrate, and (c) forming an electrically conductive conduction layer over the electrode layer by;

(i) placing the substrate in a plating solution, (ii) applying a first current to the substrate at a forward bias and a first density for a first duration, where the first duration corresponds to a depletion time of the plating solution in the etched feature, (iii) applying a second current to the substrate at a reverse bias and a second density for a second duration, where the second duration corresponds to a replenishment time of the plating solution in the etched feature, wherein the second density of the second current is between about two times and about four times the first density of the first current (iv) applying a dead time where no current is applied to the substrate, and (v) cyclically applying steps (ii) through (v) at a frequency of between about thirty hertz and about one hundred and thirty hertz.

10. The method of claim 9 wherein the first duration is between about four and about twenty milliseconds.

11. The method of claim 9 wherein the second duration is between about one and about four milliseconds.

12. A method of forming an electrically conductive structure on a substrate, the method comprising the steps of:

(a) forming an electrically conductive electrode layer on the substrate, and (b) forming an electrically conductive conduction layer over the electrode layer by;

(i) placing the substrate in a plating solution, (ii) applying a direct current patch deposition at a forward bias, (iii) applying a first current to the substrate at a first forward bias and a first density for a first duration, (iv) applying a second current to the substrate at a second reverse bias and a second density for a second duration, wherein the second density of the second current is between about two times and about four times the first density of the first current (v) cyclically applying the first current and the second current at a frequency of between about thirty hertz and about one hundred and thirty hertz, and (vi) applying a direct current bulk deposition at a forward bias.

13. The method of claim 12 wherein the first duration is between about four and about twenty milliseconds and the second duration is between about one and about four milliseconds.

* * * * *